United States Patent [19]

Crump

[11] Patent Number: 4,757,561

[45] Date of Patent: Jul. 19, 1988

[54] CONVERTIBLE SHOWER STALL PLATFORM AND RAMP COMBINATION

[76] Inventor: Robert E. Crump, 1503 Thackeray Dr., Louisville, Ky. 40205

[21] Appl. No.: 92,654

[22] Filed: Sep. 3, 1987

[51] Int. Cl.[4] ..... A47K 3/22

[52] U.S. Cl. ..... 4/604; 4/661; 193/41

[58] Field of Search ..... 4/605, 604, 621, 596, 4/254, 559, 612, 555, 661; 119/82; 297/DIG. 4; 280/289 WC, 242 WC; 193/41

[56] References Cited

U.S. PATENT DOCUMENTS

| | | | |
|---|---|---|---|
| 3,090,969 | 5/1963 | Maling | 4/611 |
| 3,169,253 | 2/1965 | Segar | 4/611 |
| 3,638,910 | 2/1972 | Nellis et al. | 193/41 |
| 3,703,733 | 11/1972 | McLouglin | 4/560 |
| 4,155,126 | 5/1979 | Classen | 4/661 |

FOREIGN PATENT DOCUMENTS

| | | | |
|---|---|---|---|
| 0123325 | 10/1984 | European Pat. Off. | 4/555 |

*Primary Examiner*—Henry K. Artis

*Assistant Examiner*—L. J. Peters

*Attorney, Agent, or Firm*—Richard Caslin; Scott R. Cox

[57] ABSTRACT

A convertible shower stall platform and ramp combination is shown for use with an invalid's shower chair. The shower stall platform has leveling screws and a vertical flange around at least three sides and drain holes formed near the rear flange. There is a ramp for connection to the front edge of the platform. A turning platform may also be used assembled to the front edge of the shower stall platform where the ramp is capable for connection to either the right or left side of the turning platform and quick-release pins are provided between the ramp and turning platform and between the turning platform and the shower stall platform. The sides of the ramp and of the turning platform have vertical, upturned flanges to guide and retain the wheels of the invalid's chair as the invalid is transported up the ramp and onto the shower stall platform by an attendant. There is a removable safety bar installed across the front edge of the shower stall platform to retain the invalid's chair within the shower stall.

5 Claims, 4 Drawing Sheets

CONVERTIBLE SHOWER STALL PLATFORM AND RAMP COMBINATION

BACKGROUND OF THE INVENTION

1. Field of the Invention:

This invention relates to the art of accessories for handicapped people when they are being treated and cared for in the home or, perhaps, in a nursing home. Many handicapped people and invalids are unable to use a bathtub or a shower in a bathtub because of the danger that they may faint and fall and hurt themselves. Also, many of these handicapped people and invalids must be washed by the attendant so that the invalid will not over-exert themselves and, perhaps, have an accident and injure themselves.

2. Description of the Prior Art:

The Applicant is not aware of any patents in this art. It is believed that prior to the introduction of the present invention that renovation would be made of the shower curb so that it would help to lift the shower stall chair over the curb and into the shower stall for use by the invalid. Either the curb would be eliminated or it would be lowered, or a permanent tile ramp would be built so that the chair could ride over the curb. All this renovation work is very expensive, and it may have to be redone when the house is sold to a family not having an invalid.

OBJECTS OF THE PRESENT INVENTION

The principal object of the present invention is to provide a portable, convertible shower stall platform and ramp combination for use with an invalid's shower chair for cleansing and caring for handicapped people.

A further object of the present invention is to make it possible to store this convertible shower stall platform and ramp combination in the shower stall itself when the stall is not being used.

A further object of the present invention is to provide a shower stall platform with the provision of a turning platform so that the ramp can allow for right-hand entry or left-hand entry if it is not possible to have straight entry into the shower stall. The invalid rides this chair up the ramp and onto the shower stall platform. This invention is to be used only with the assistance of a qualified attendant. The invalid would not walk up the ramp but would ride up in the chair. The level of the shower platform is provided with adjustable adjusting bolts so that the platform slopes down from front to rear so that the water will not accumulate along the front edge and will drain towards the drain holes formed near the rear wall of the shower platform. There are quick-release pins between the ramp and the turning platform and between the turning platform and between the shower stall platform so that the various elements will not become disassembled inadvertently. There is a safety bar assembled across the front edge of the shower stall platform.

SUMMARY OF THE INVENTION

The present invention provides a convertible shower stall platform and ramp combination for use with an invalid's shower chair. Adjustable leveling bolts are provided for the shower stall platform, and a turning platform is available to those that may need that in case a right-hand or left-hand entry is desired into the shower stall. The ramp is capable of connection to either the right or left side of the turning platform. Quick-release pins are provided between the ramp and the turning platform and between the turning platform and the shower stall platform. The sides of the ramp and of the turning platform have vertical, upturned flanges to guide and retain the wheels of the invalid's chair, and there is a removable safety bar installed across the front edge of the shower stall platform to retain the invalid's chair within the shower stall.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
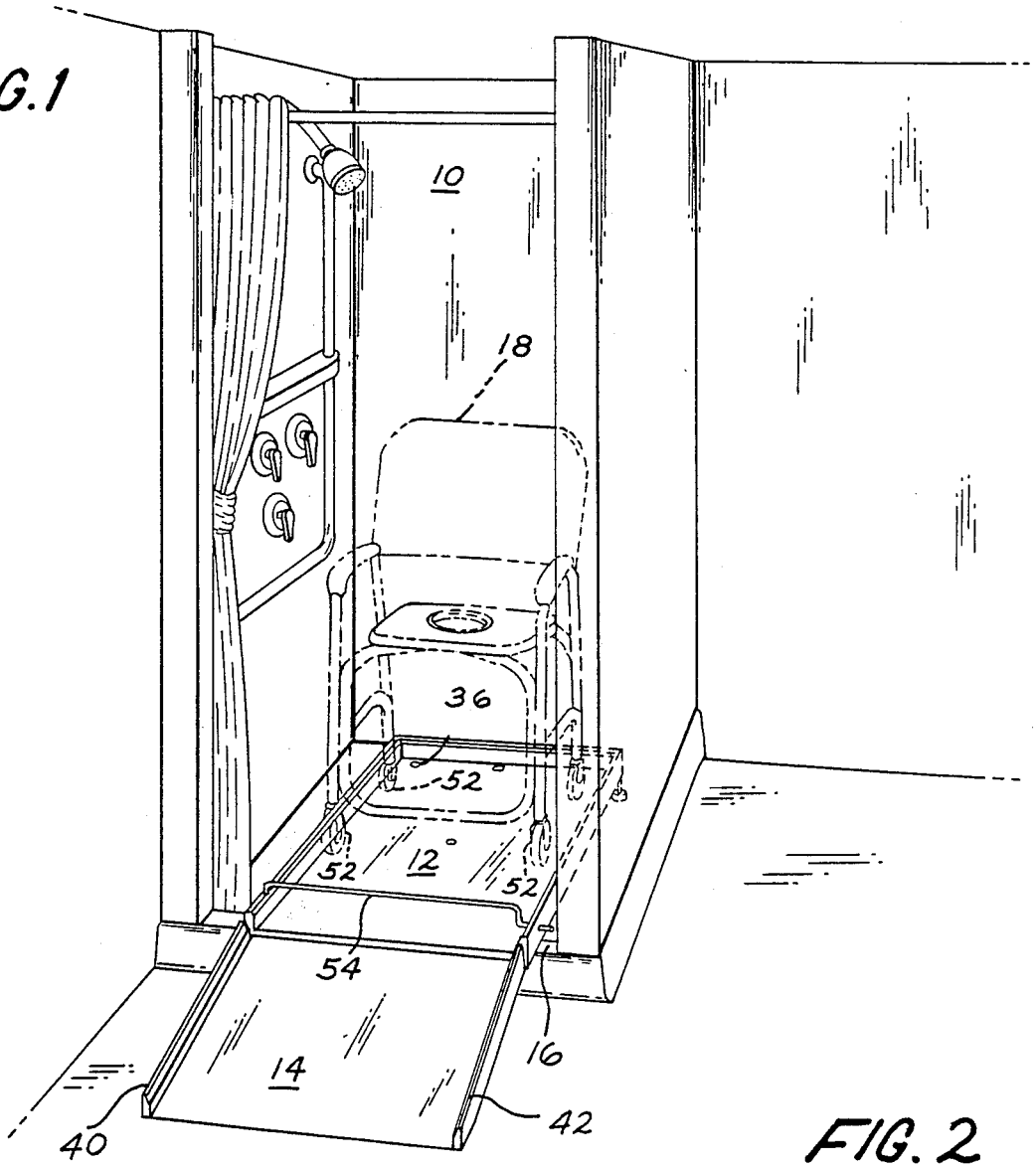
FIG. 1 is a perspective view of a shower stall for use by an invalid in a residence or in a nursing home.

Turning now to a consideration of the drawings and, in particular, to the perspective view of FIG. 1, there is shown a shower stall 10 that is furnished with the convertible shower stall platform and ramp combination 12, which is the subject of the present invention. An inclined ramp 14 is shown connected to the front edge of the platform 12 to overcome the curb 16 of the shower stall 10. The purpose of the curb 16 is to retain the water that accumulates in the bottom of the shower stall 10, as is well understood in this art. All of this is to afford a shower chair 18 for use by an invalid in the shower stall to overcome the shower stall curb 16 without costly remodeling of the shower stall by providing a permanent tile ramp up to the curb 16 and off the curb 16. All of the platform 12 and the inclined ramp 14 and the turning platform 20 are made of lightweight panels of high density polyethelene such as is used for cutting boards in the kitchen. These panels may be easily stored right in the shower stall 10 when the shower is not being used.

It is usually a major task to maintain the cleanliness and hygiene of an invalid because an invalid usually cannot bathe himself and must be accompanied by an attendant at all times to make sure that the invalid doesn't fall and injure himself.

Figure 3:
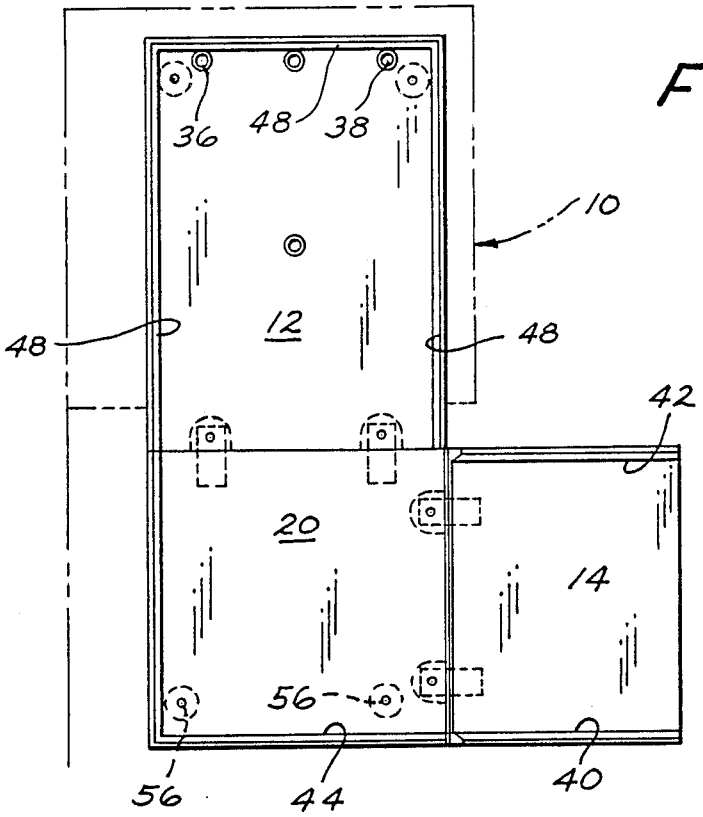
FIG. 3 is a top plan view of the present invention showing the shower stall platform provided with a turning platform connected to the front edge of the shower stall platform and a ramp leading up to the right side of the turning platform so that the invalid may sit in his shower stall chair and an attendant may push the invalid up the ramp and turn the chair on the turning platform and then be pushed into the shower stall.
Figure 4:
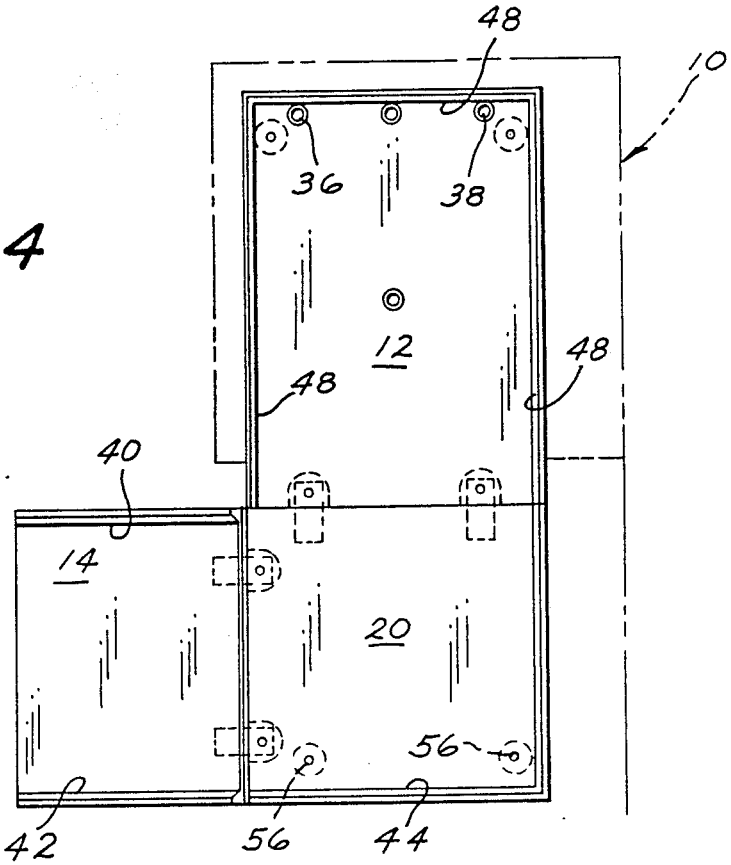
FIG. 4 is a top plan view of the present invention, similar to that of FIG. 3, showing a left entry to the turning platform that is connected to the front edge of the shower stall platform. The ramp has been reversed from the right-hand side of the turning platform to the left-hand side.

FIG. 1 shows a front entry of the shower chair 18 into the shower stall 10 because the inclined ramp 14 is joined to the front edge of the shower stall platform 12. Depending upon the design of the shower area, it sometimes happens that the invalid needs to have a right-hand entry into the shower stall. This is provided, as is shown in FIG. 3, by providing a turning platform 20 between the inclined ramp 14 and the shower stall platform 12. FIG. 3 shows the ramp 14 connected to the right-hand edge of the turning platform 20, while FIG. 4 shows the inclined ramp 14 connected to the left-hand edge of the turning platform 20. The invalid sits in the shower chair 18 and is strapped in with a safety belt (not shown) and is propelled by an attendant up the ramp 14 and onto the turning platform 20 where the chair is turned, and then the chair is pushed into the shower stall 10 onto the shower stall platform 12. Thus, the invalid, who is usually shaky on his feet, is not forced to walk into the shower stall 10.

Figure 5:
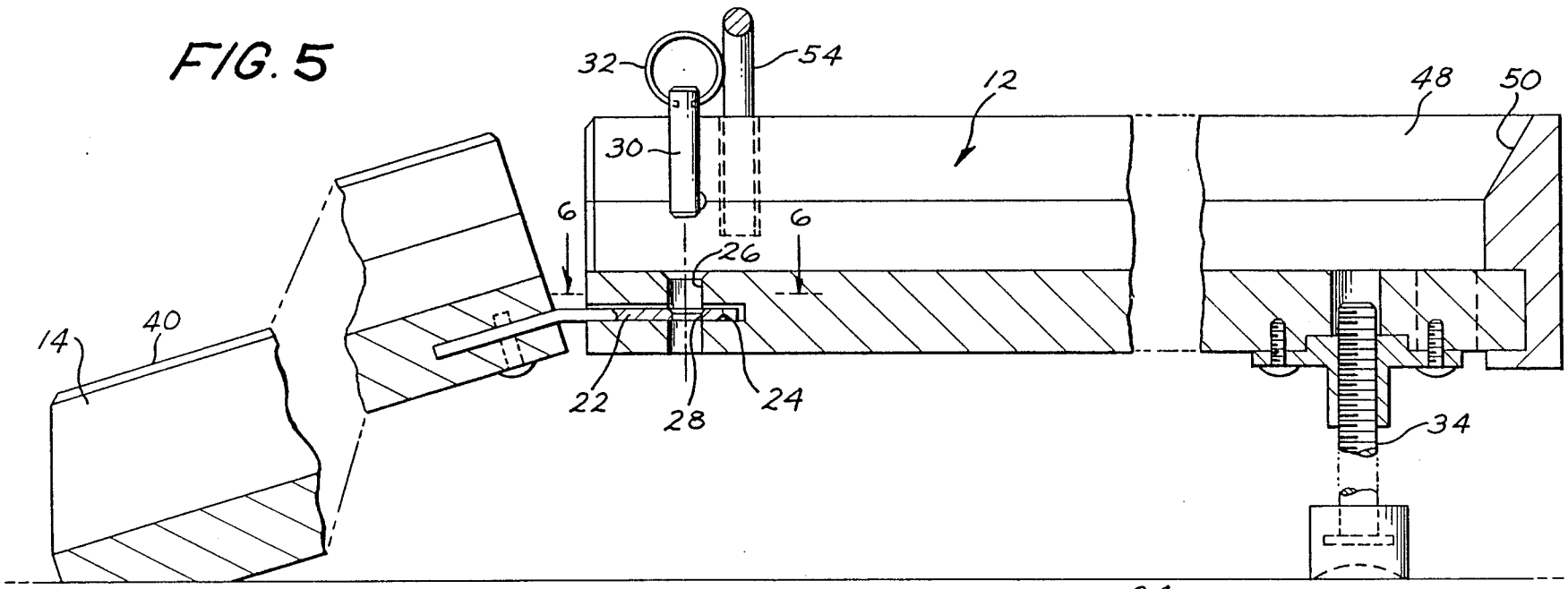
FIG. 5 is a cross-sectional elevational view, taken on the Line 5—5 of FIG. 2, of the shower stall platform showing the leveling bolts and also showing the ramp connected to the front edge of the shower stall platform.
Figure 6:
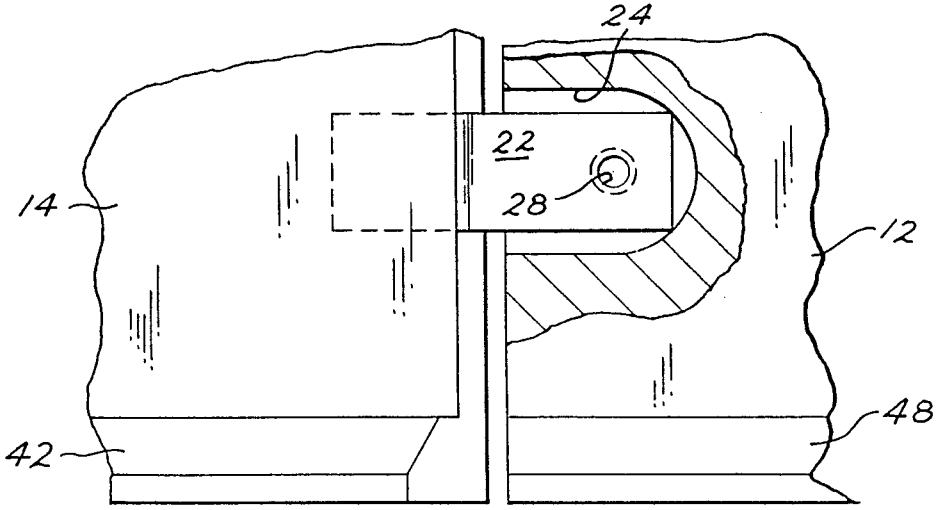
FIG. 6 is an enlarged fragmentary view, taken on the Line 6—6 of FIG. 5, showing the connection between the ramp and the front edge of the shower stall platform.
Figure 7:
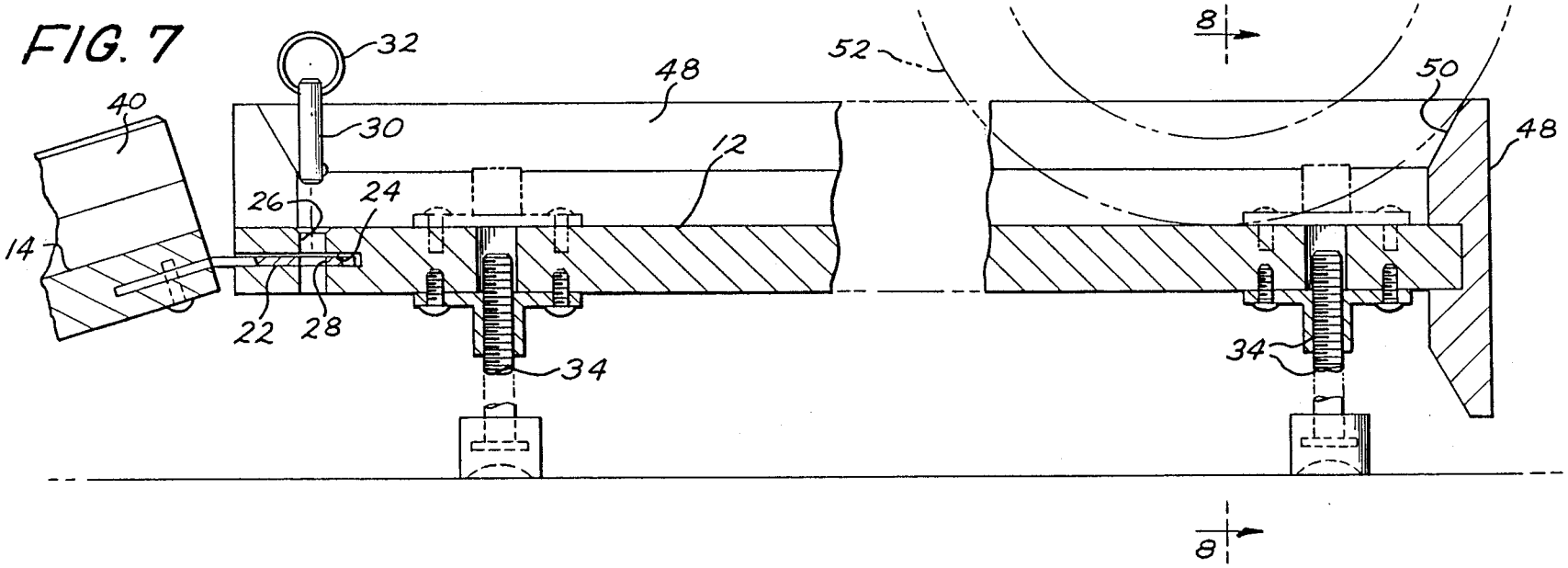
FIG. 7 is a cross-sectional view, similar to that of FIG. 5, showing leveling bolts also mounted at the front edge of the shower stall platform as well as at the rear edge of the platform.
Figure 9:
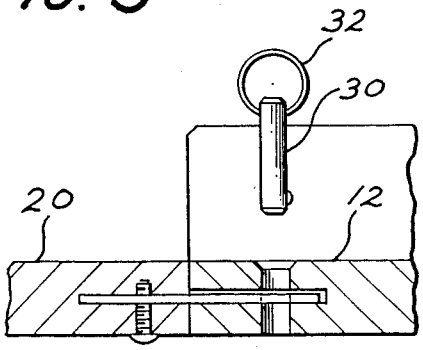
FIG. 9 is a fragmentary view showing the quick-release pin between the shower stall platform and the tongue of the turning platform that is connected to the shower stall platform.
Figure 8:
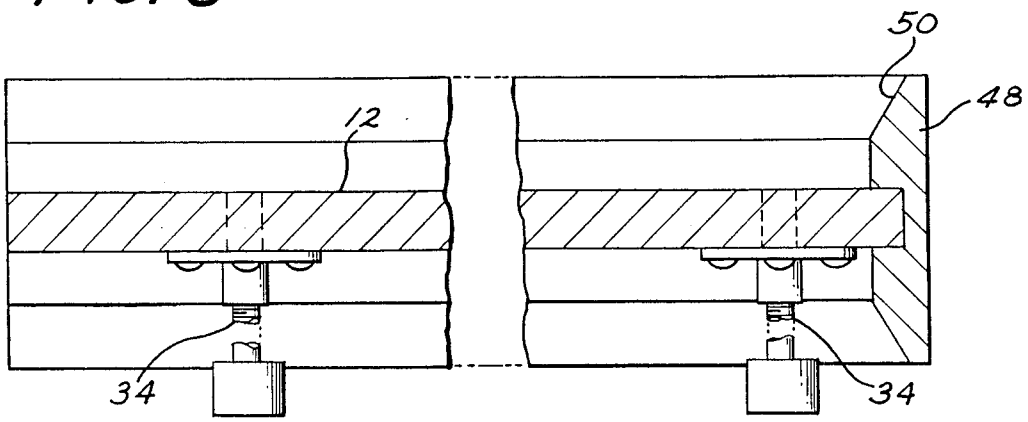
FIG. 8 is a view taken on the Line 8—8 of FIG. 7.

There is a coupling method between the inclined ramp 14 and the turning platform 20, as well as between the inclined ramp 14 to the front edge of the shower stall platform 14, as is best shown in FIGS. 5 and 6. The inclined ramp 14 is provided with outwardly projecting tongue members 22, each of which fits into an envelope 24 that receives the tongue. The platform to which the inclined ramp is connected is provided with holes 26. Similarly, the tongue member 22 is provided with holes 28 to be in alignment to the holes 26 for receiving a quick-release locking pin 30, each of which is provided with a ring member 32 for ease in pulling the pin when the connection is to be disconnected. The front edge of the shower stall platform 12 is resting on the shower stall curb 16. There are leveling screws and bolts 34 provided at the two rear corners of this platform 12 to complement the height of the shower stall curb 16 so that this shower stall platform 12 is generally level. Actually, it is best that this shower stall platform 12 have a slight slope from front edge to back to discourage the shower chair 18 from riding out of the shower stall and also to encourage the water to flow towards the rear of this platform 12. There is a very slight slope of just a half-an-inch. The rear edge is a half-an-inch lower than the front edge.

Figure 2:
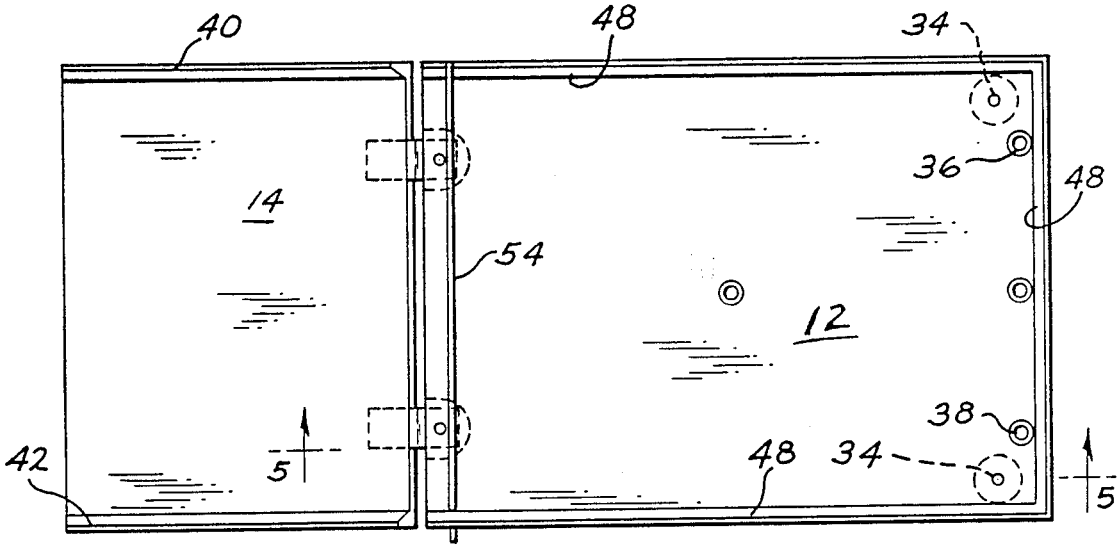
FIG. 2 is a top plan view of the shower stall platform that is installed in the bottom of the shower stall of FIG. 1.

Notice, in FIG. 2, the drainage holes 36 and 38 in the two rear corners of the shower stall platform 12. Both of these drainage holes are countersunk to readily discharge the water buildup on the platform 12 through the drainage holes so that the water will reach the sewer drain (not shown) that is built in the center of the floor of this shower stall 10.

The inclined ramp 14 is provided with vertical flanges 40 and 42 on the opposite sides to help to guide the swivel wheels 52 of the shower chair 18 as the invalid is pushed up the ramp and onto the turning platform 20 and then finally onto the shower stall platform 12.

In a similar manner, the turning platform 20 has a vertical flange 44 that represents an extension of the vertical flange 40 of the inclined ramp 14, and it is located along the front edge of the turning platform 20. It represents an extension of the vertical flange 40 of the inclined ramp 14 when there is a right-hand entry, as shown in FIG. 3, while in FIG. 4 it is an extension of the other vertical flange 44 of the vertical flange 42. The shower stall platform 12 also has vertical flanges 48 around three sides thereof: the two opposite sides and the rear side. As is best seen in FIG. 5, these vertical flanges 48 of the shower stall platform 12 are beveled, as at 50. A removable safety bar 54 is assembled between the vertical flanges 48 at the side of the shower stall platform 12, as is best seen in FIG. 1. The bevel 50 allows the swivel wheels 52 of the chair 18 greater clearance to turn within the confines of the platform 12 then would be possible if the top edge of the flange 48 were square.

Modifications of this invention will occur to those skilled in this art. Therefore, it is to be understood that this invention is not limited to the particular embodiments disclosed but that it is intended to cover all modifications which are within the true spirit and scope of this invention as claimed.

What is claimed is:

1. A convertible shower stall platform and ramp combination for use with an invalid's shower chair comprising:

a. a shower stall platform with leveling means, and a vertical flange around at least three sides, and drain holes formed near the rear flange;

b. and a ramp for connection to the front edge of the platform;

c. and a turning platform assembled to the front edge of the shower stall platform, said ramp being capable for connection to either the right or left side of the turning platform, and locking means between the ramp and turning platform and between the turning platform and the shower stall platform, the sides of the ramp and of the turning platform having vertical upturned flanges to guide and retain the wheel of the invalid's chair, and a removable safety bar installed across the front edge of the shower stall platform to retain the invalid's chair within the shower stall.

2. The convertible shower stall platform and ramp invention as recited in claim 1 wherein the platform and ramp are made of panels of high density polyethylene.

3. The convertible shower stall platform and ramp invention as recited in either claim 1 or 2 wherein one member is fitted with outwardly projecting tongue members and an adjacent member is furnished with envelopes to receive the said tongue members and a vertical locking pin fitted in a vertical hole in each envelope and mating tongue for making a releasable locking connection between the member with the tongue members and the adjacent member.

4. The convertible shower stall platform and ramp invention as recited in claim 2 wherein the drain holes in the shower stall platform are countersunk.

5. The convertible shower stall platform and ramp invention as recited in claim 1 wherein the front portion of the shower stall platform is supported on the front curb of the shower stall while the said leveling screws support the rear portion of the shower stall platform, and the said ramp is capable of raising the invalid's shower chair up to the shower stall platform, over the shower stall front curb that retains the water that builds up in the shower stall, and the level of the shower stall platform is adjusted to have a slight slope from front to rear to direct the water toward the said drain holes.

* * * * *